United States Patent [19]

Brown

[11] 4,030,631

[45] June 21, 1977

[54] EASY-OPEN ECOLOGY END

[75] Inventor: Omar L. Brown, Dayton, Ohio

[73] Assignee: Ermal C. Fraze, Dayton, Ohio

[22] Filed: Aug. 27, 1975

[21] Appl. No.: 608,044

[52] U.S. Cl. ..... 220/269

[51] Int. Cl.[2] ..... B65D 41/32

[58] Field of Search ..... 220/269, 270, 272, 273, 220/277

[56] References Cited

UNITED STATES PATENTS

| | | | |
|---|---|---|---|
| 3,825,149 | 7/1974 | Brown et al. | 220/270 |
| 3,836,038 | 9/1974 | Cudzik | 220/269 |
| 3,843,011 | 10/1974 | Perry | 220/269 |
| 3,967,752 | 9/1976 | Cudzik | 220/269 |

*Primary Examiner*—George T. Hall
*Attorney, Agent, or Firm*—George F. Smyth

[57] ABSTRACT

An improved easy-opening end structure for use with a container includes a retained tab and a captured panel which is also retained. The end structure includes a scoreline of an improved pinched score variety, defining a pour opening formed by fracture of the scoreline to release the panel formed by the scoreline. Preferably, the panel is retained on the end. The tab is affixed to the end, other than to the panel and includes an opening end positioned over the panel, but not secured thereto, and a lifting end spaced from the panel which is preferably downwardly dished and generally circular in shape. As the lifting end is raised, the portion of the scoreline between the opening end of the tab and the attachment is popped by an upward lift of the end through essentially a class 2 lever action and thereafter the opening end bears against the panel as the tab is raised further to complete rupture of the scoreline by essentially a class 1 lever action and to push the panel downwardly and laterally through the formed opening. The panel may be hinged or fall free into the container. Various types of tabs as well as a method of forming a scoreline and various end structures are described.

26 Claims, 29 Drawing Figures

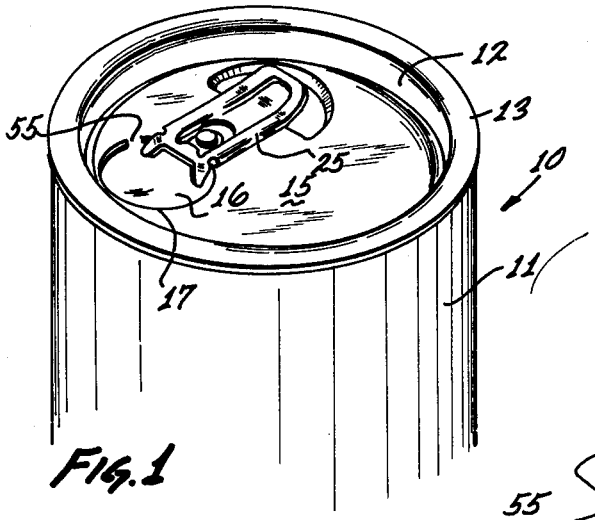
FIG. 1
FIG. 2
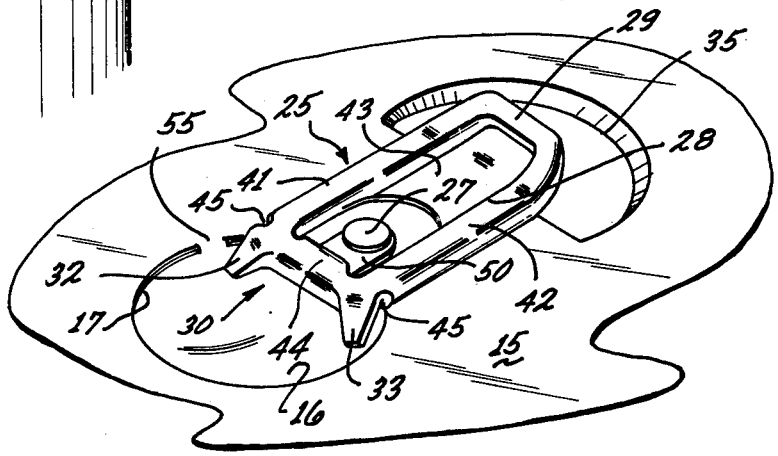
FIG. 3
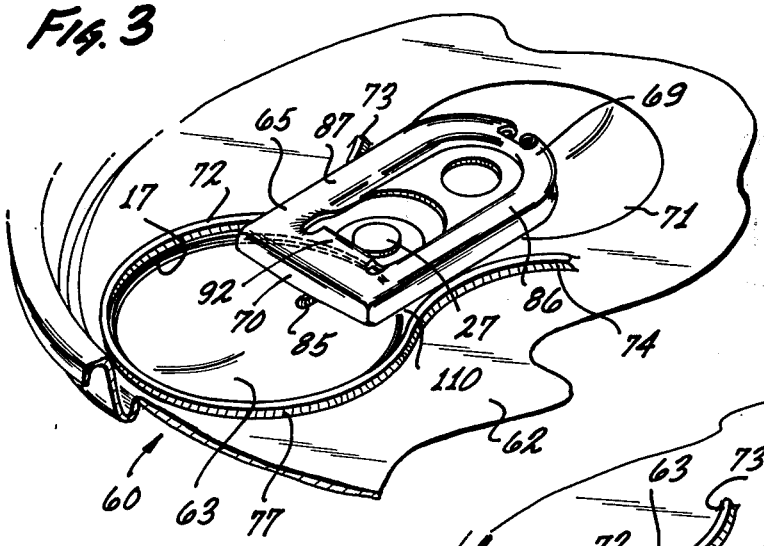
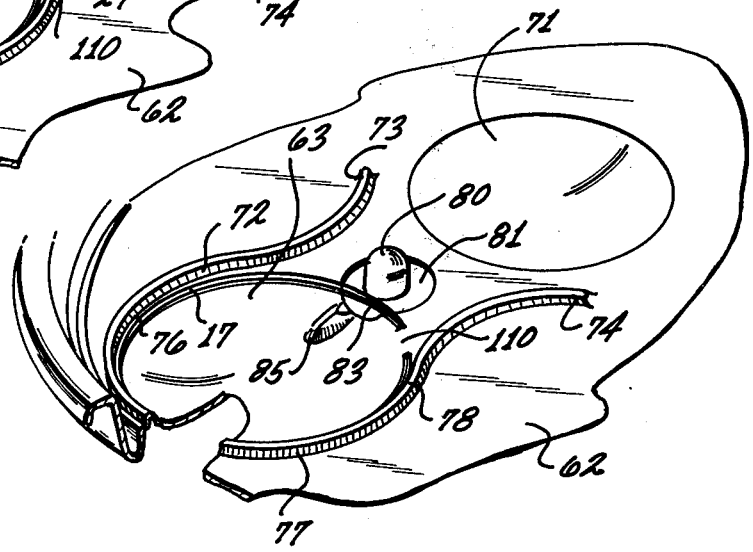
FIG. 4

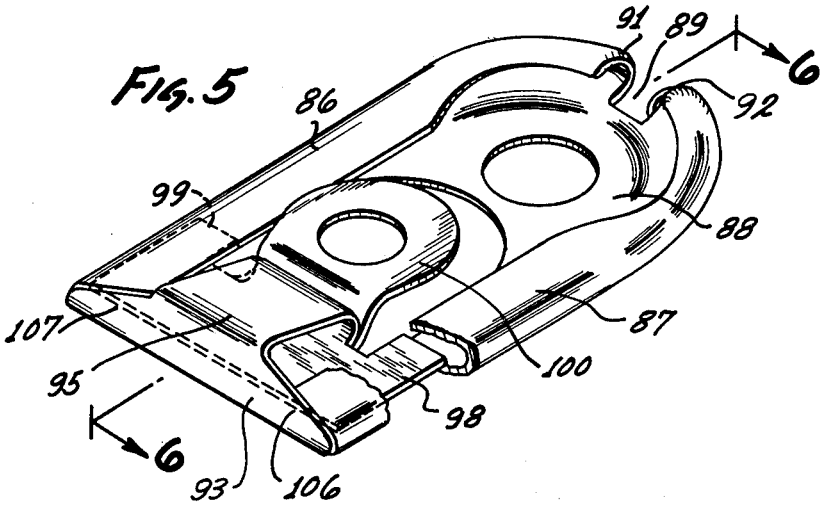
FIG. 5
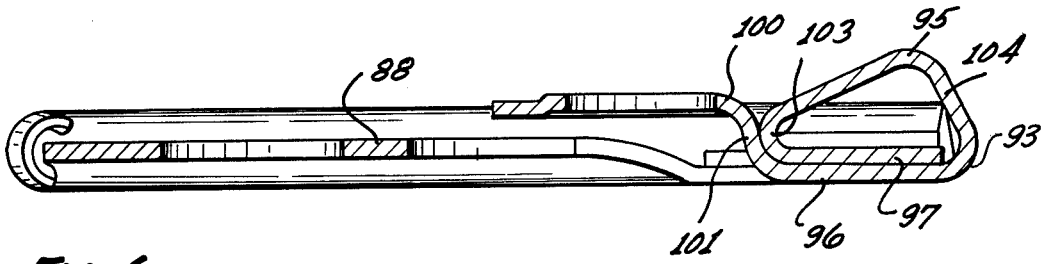
FIG. 6
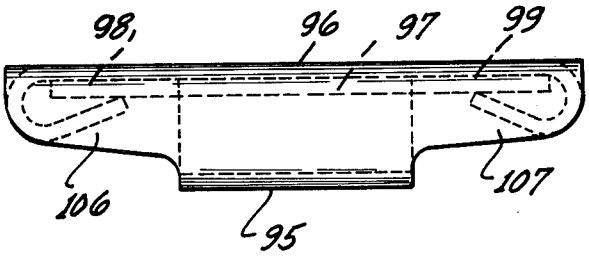
FIG. 7
FIG. 8
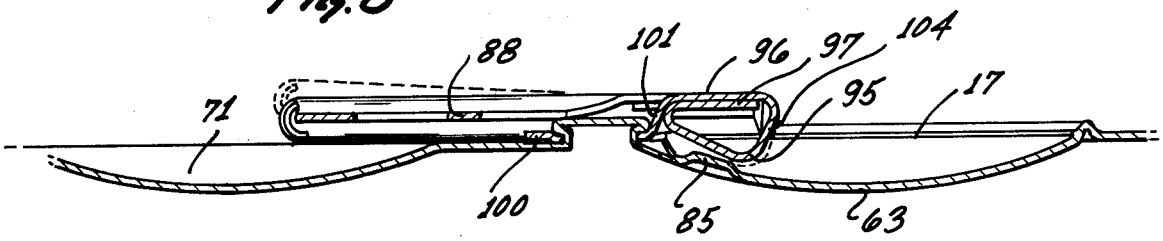

125
137
130
134
140
126
133
136
132
120
128

137
150
140
147
148
146

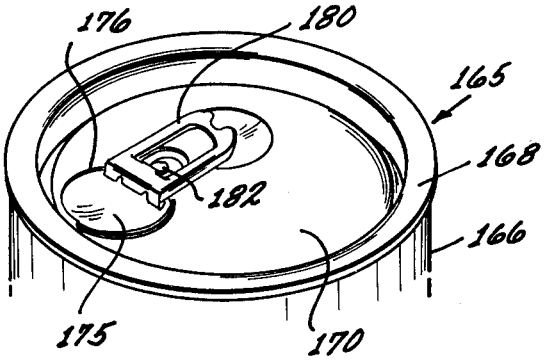
FIG. 15
FIG. 16
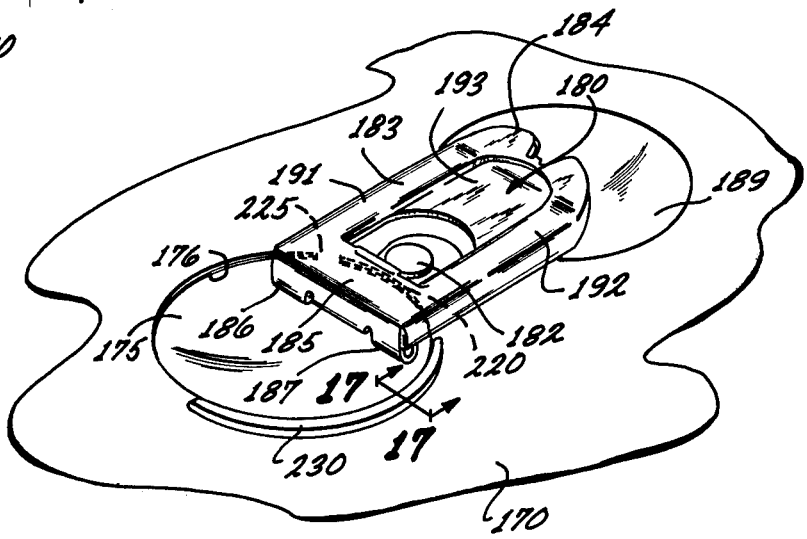
FIG. 18
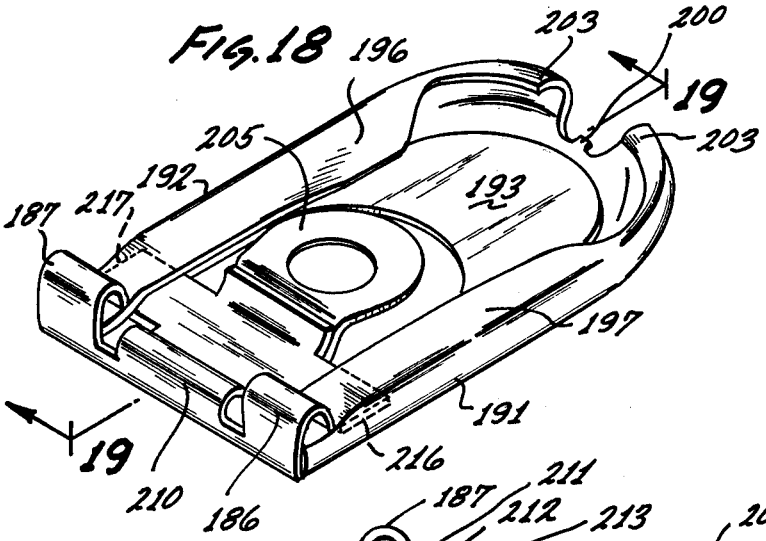
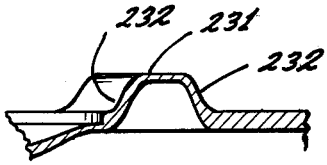
FIG. 17
FIG. 19
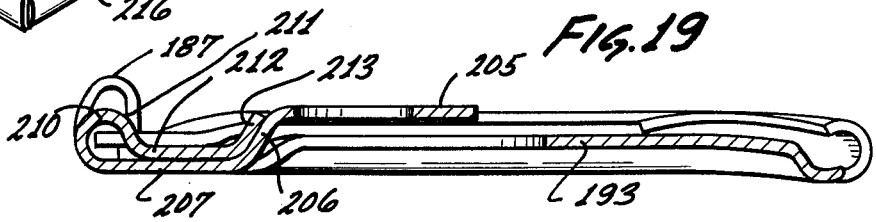

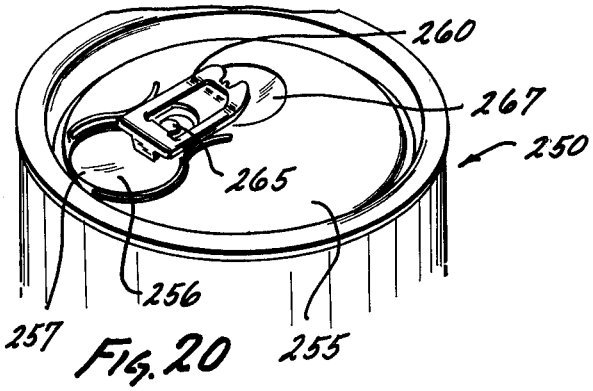
FIG. 20
FIG. 21
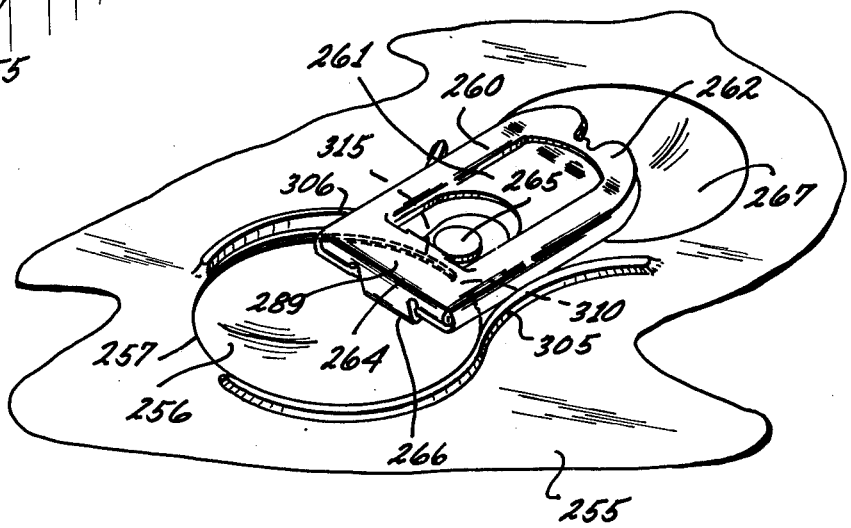
FIG. 22
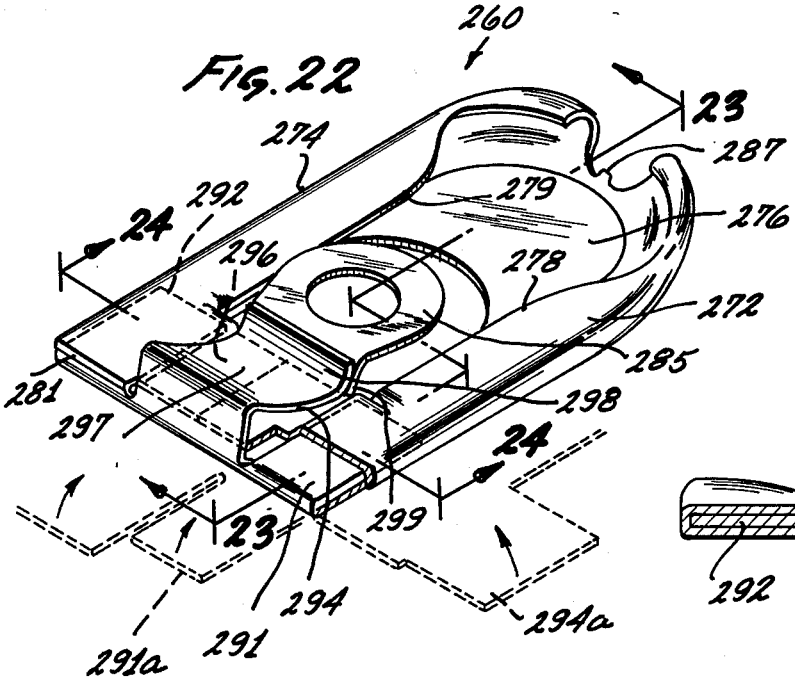
FIG. 24
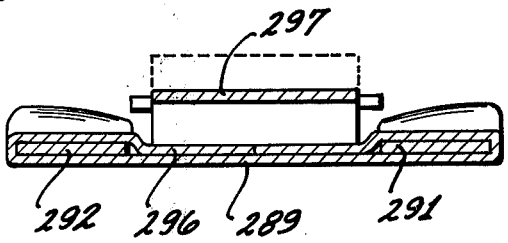
FIG. 23
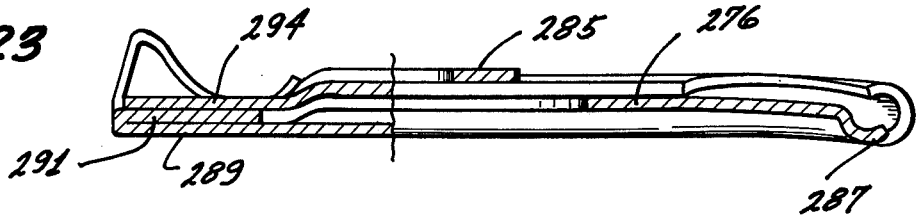

FIG. 25
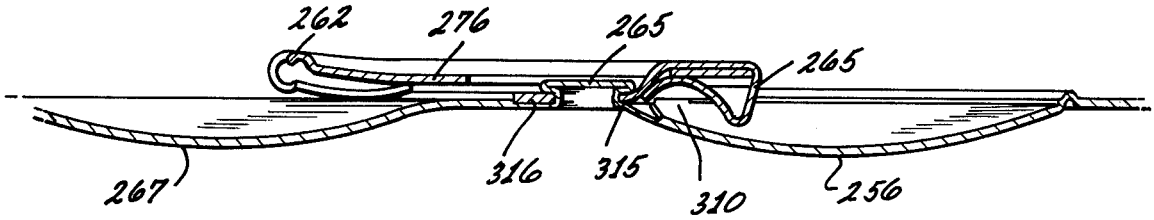
FIG. 26
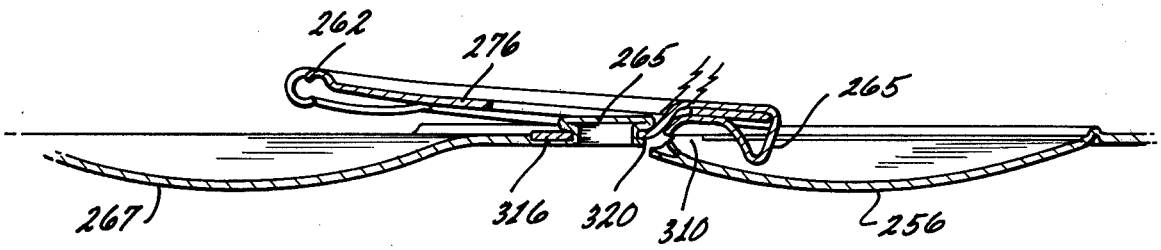
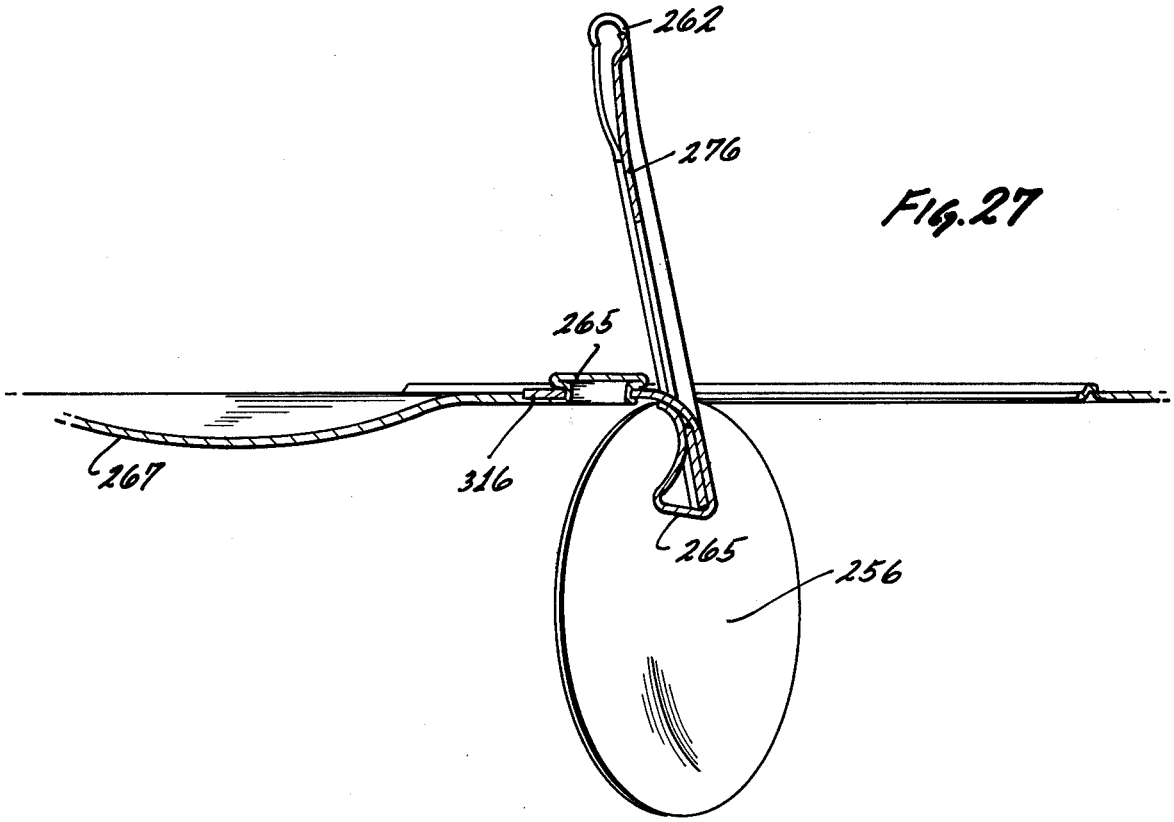
FIG. 27

EASY-OPEN ECOLOGY END

BACKGROUND OF THE INVENTION

This invention relates to an easy-opening container end wall, and more specifically to an improved easy-opening end wall having a retained tab member operative to form an opening in the end wall by rupture of a tear opening such that the ruptured tear portion also remains with the container.

The ready acceptance of easy-opening containers has resulted in extended use of this type container for a substantial number of canned products, especially beverages, such as beer, soft drinks, and the like. This type of container, in the form of a can, is characterized by a lever or tab permanently joined to a tear strip, the latter being separable from the can top to provide a pouring spout. In the form heretofore used, the tab or top is ruptured along a continuous scoreline and the pull tab and tear strip are removed as a unit and normally discarded.

The convenience of easy-opening cans has created problems because of the unfortunate and indiscriminate disposal of the severed portion of the can top. For example, beach and picnic areas have an accumulation of litter in the form of tabs and tear strips which have been removed from easy-opening cans. These discarded tabs and tear strips are quite difficult to clean up because they are small and thus pass through the tines of a rake. Being made normally of aluminum, they cannot be collected by magnetic means. Nonetheless, this type of can is widely used and it is definitely advantageous to provide a solution to the problem of littering while still providing to the public the convenience of the easy-opening cans.

The numerous advantages incident to the use of easy-opening cans has given rise to an industry which has developed to the point where standard procedures and equipment are now in widespread use. For example, many of the machines now used to form the end wall of a container include five stations in which various operations are performed to provide an end unit for a container. By way of example, the first station usually forms the "bubble," transformed into a button in the second station, followed by scoring and forming the rupturable container opening in the third station. In the fourth station any embossing of logo or other information in the container end is carried out, and in the fifth station the tab is attached, i.e. staked to the end unit.

Those in the industry are aware of the need to provide convenience containers of the easy-opening type which overcome the problems of indiscriminate disposal of tabs and tear strips from an ecological standpoint. The provision of a solution to this problem, is somewhat complicated by the fact that whatever end is designed, it is desired that the end be one capable of being made on machines presently in use and which can be modified by changes of tooling in each of the stations generally used in the formation of the end wall without the need to add additional stations. If, for example, an end is designed which requires more than five separate operations, there are practical problems in bringing such an end into commerce because of the need to replace or to rebuild substantially the presently existing equipment in order to add one or more stations. Thus, any structure of an end wall which can be considered an ecology end from the standpoint of having some form of retained tab or tear strip or both and which can be made on currently existing machines with modified tooling at each of the currently existing stations has definite advantages.

Moreover, it is fairly recognized at present that standards have been established with respect to the length and diameter of the component parts and the gauge of materials used in the packaging industry, particularly the soft drink and beverage industry. Thus, in the design of a container end wall intended to form an easy opening end wall for use in the beer and beverage industry, it is desirable to maintain the dimensions of any new structure fairly within the dimensions currently in use in those respective industries.

One of the difficulties which arises in the provision of an end having substantial improvements from the standpoint of ecology is the mode of opening of the end wall. For example, the user has been accustomed to lifting the end of the tab in order to effect rupture of the tear strip. Thus, with certain types of end wall structures presently being marketed and which include push button panels, some user confusion has existed because the structure of the end wall does not include the tab. While the structure just described is intended to be opened by pushing down on the scored button to rupture the same, some users are confused by the absence of any tab or lever.

Another aspect in the provision of an easy-opening end structure which has ecological advantages is the variety of products present in the container with which the end wall is to be used. By way of example, it is known that the internal pressure in the container may vary depending upon the type of product within the container as well as the processing during packaging. For example, some beverages are packaged under considerable pressure, in some cases as much as 50 to 80 psi while other products are packaged at a somewhat lesser pressure. The packaged completed container must then be capable of withstanding substantial pressures as might be generated if the container is exposed to direct sunlight which tends to increase the internal pressure within the container. For example in some operations, the can is sealed and pasteurized resulting in the generation of internal pressure within the can.

Thus, it is definitely advantageous to be able to provide a container end structure which has wide applicability insofar as the various conditions involved in packaging the product within the container. Thus, the usual procedure is to attempt to provide a container end wall capable of withstanding the most rigorous conditions required by the industry such that a single design of end may be used over a wide variety of products. Moreover, there is the added requirement that the end structure be capable of manufacture at the usual high rates currently employed by the container industry with the equipment presently used, subject to the change of tooling necessary to adapt the presently existing multiple station machines in order to produce any new and improved end.

In summary, there are constraints within which the industry operates both from the standpoint of the standards which have been adopted, the cost of changeover and the desire to provide an end structure which is satisfactory from the standpoint of reducing the litter which has accumulated by virtue of separable tabs and tear strips.

DESCRIPTION OF THE PRIOR ART

One approach in solving the ecology problems has been to provide a container end structure with a retained tab and tear strip, as for example in U.S. Pat. No. 3,757,989 of Sept. 11, 1973. In that structure, the tab is attached to the tear strip and the tear strip is retained on the end structure subsequent to rupture of the scoreline.

Another approach is described in U.S. Pat. No. 3,795,342 of Mar. 5, 1974, in which the tab is retained with the end structure and folded in a stowing location subsequent to rupture of the tear strip.

There is still another approach to the problem as described in U.S. Pat. No. 3,446,389, of May 27, 1969, in which a tab is attached to the end wall of the container such that the nose thereof overlies a rupturable panel. Upon lifting of the free end of the tab, the nose ruptures a scoreline which is aligned with the center line of the nose and the rivet so as to form two panel sections which are forced downwardly into the container and out of the way. The tab is then pushed back against the end wall.

U.S. Pat. No. 3,826,401 of July 30, 1974, shows an opening member in the form of a lever which is operative to rupture a scoreline laterally disposed with respect to the rivet, the lever being permanently attached to the end wall.

U.S. Pat. No. 3,853,242 of Dec. 10, 1974, describes a lever member affixed to the end wall in which the lever member includes a panel piercing portion and a finger grasping portion. The lever is rotatable in a plane normal to the panel to rupture a weakening line.

U.S. Pat. No. 3,807,597 of Apr. 30, 1974, describes an end structure for a container including an opening member which is movable from a non-use position into alignment with a scored section.

Push button panel type container end walls are known in which the removable panel is manually pushed into the container, see for example U.S. Pat. No. 3,886,881 of June 3, 1975.

In the main, however, most easy-open containers include an end structure wherein the tear strip is severed by manipulation of the tab to form a pour opening. In this type of container, shown for example in U.S. Pat. No. 3,723,744 of Sept. 20, 1966, the tab acts as a class 2 lever in its opening action, the rivet being in the tear out panel while the portion of the scoreline initially ruptured is between the lifting end of the tab and the rivet.

Also known in the art are end structures in which the tab operates as a class 1 lever, i.e. the rivet is between the lifting end and the scoreline and the nose of the tab operates to rupture the scoreline, as for example in U.S. Pat. No. 3,446,389 supra.

A class 2 lever tab effects rupture basically by a lifting action, definitely an advantage where the packaged goods are under pressure since the opening action does not oppose the internal container pressure. In the prior art class 2 lever tabs, the front end of the tab bears against the end wall other than in the pour opening defined by the scoreline. In a class 1 lever type tab, the opening action is downward, and, if the container is under pressure, there is a tendency for the internal pressure of the container to act in opposition to the opening action.

One of the structures being considered from the ecology point of view uses a lanced tab, for example as shown in U.S. Pat. No. 3,406,867 of Oct. 22, 1968, affixed by a rivet to an end wall. The forward nose of the tab overlies a circular raised bead located in the general central area of a scored section which forms the pour opening. The score line is non-circular in shape and the tab is affixed in the center of the end structure, generally along the center line of the end with the pour opening adjacent to the chuck wall and in line with the tab.

SUMMARY OF THE INVENTION

The end structure of the present invention differs from the prior art structures above described in that the tab operates as a class 2 lever which is not attached to the portion of the end wall ruptured to form the pour opening. Thus several significant functional and practical advantages accrue.

For containers under pressure, a class 2 lever opens by a lifting action and accordingly the initial rupture of the scoreline at the start of the opening action is not opposite the force created by any pressure within the container. This "initial pop" and simultaneous venting action is achieved by start of rupture of the principal scoreline. Since the tab is not attached to the panel which is ruptured to form a pour opening, the tab remains with the end wall and is not discarded as a separable item which produces troublesome litter. The panel formed on rupture of the scoreline is forced downwardly in response to continued lifting of the tab which now acts as a class 1 lever in urging the panel downwardly by rupturing the remainder of the scoreline to form a pour opening. Again, the operation of the tab as a class 1 lever does not depend on rupture of a secondary or separate vent score. Since the panel is urged downwardly through the opening which forms the pour opening, the traditional separable tear strip is eliminated, thereby further reducing a potential source of litter, the severed tear strip.

Thus, functionally the improved end of this invention includes a retained tab and a separate but retained tear strip wherein the manipulative operation of the tab is similar to other easy-opening containers, but which uses a class 2 type lever attached other than to the tear strip, which lever thereafter operates as a class 1 lever to complete opening.

From the standpoint of manufacture of the end structures five station machines may be used with appropriate tooling. The overall dimensions of the end structure are compatible with container bodies presently in use and accepted as standard dimensions, a substantial practical advantage.

More specifically, the improved end structure of this invention includes an end wall having a scoreline which defines an opening panel. Although the scoreline could be continuous, it is preferably discontinuous to form a hinged panel. Attached to the end wall by a rivet or suitable means, and in a location other than on the panel, is a tab whose opening end overlies the panel and whose lifting end is spaced away from the panel. Thus, the tab remains fixed to the end wall and is not separable upon rupture of the opening.

The scoreline includes a portion located between the rivet and the opening end of the tab which overlies the panel. The tab is in the form of a substantially longitudinally rigid lever which is operative upon lifting one end thereof to initiate rupture of the portion of the scoreline between the opening end and the rivet, the initial pop, so called. Further lifting of the tab will effect rupture of the scoreline to about 50 percent of its periphery. Thereafter, the panel may be pushed in manually or the tab may be raised further to complete scoreline rupture. Whether done manually or by the tab, the result is a ruptured panel which may be hinged or which may free fall into the container like some of the push button ends known in the art.

The scoreline used in the end structure, in accordance with this invention, is of an improved pinched score variety while the panel is preferably downwardly dished and generally circular in shape, although a D shape, oval or other shape may be used, if desired.

While the end structure of this invention may take various forms, in one form an improved tab structure is used which is retained with the end wall, other than with the ruptured panel, and preferably includes a relatively rigid body member having a lifting end and an opening end with a flap member between the lifting and opening end. The flap member performs several functions including receiving an attaching member, preferably in the form of a rivet, initially rupturing the scoreline by a lifting action and retaining the tab on the end wall subsequent to completion of severance of the scoreline by the opening end which preferably includes at least one finger disposed forward of the flap member.

It will be apparent from the following detailed description that a much improved retained tab and tear strip end structure is disclosed, and the further features and advantages thereof may be best understood by reference to the following description taken in connection with the accompanying drawings.

BRIEF DESCRIPTION OF THE DRAWINGS

FIG. 1 is an isometric view of the improved end structure of the present invention assembled to a container body shown fragmentally;

FIG. 2 is an enlarged view in perspective of a portion of the end structure shown in FIG. 1;

FIG. 3 is an isometric view, partly broken away, of another form of the improved end structure of the present invention;

FIG. 4 is a view similar to FIG. 3, and partly broken away with the tab removed and prior to staking of the tab;

FIG. 5 is a view in perspective of the underside of the tab shown in FIG. 3 in accordance with this invention;

FIG. 6 is a view partly in section and partly in elevation taken along the line 6—6 of FIG. 5;

FIG. 7 is a view of the front of the opening end of the tab in accordance with this invention;

FIG. 8 is an enlarged view partly in elevation and partly in section of the end of FIG. 3 showing the relative relationship of parts at the start of an opening sequence;

FIG. 15 is an isometric view of another form of the improved end structure of the present invention assembled to a container body shown fragmentarily;

FIG. 16 is an enlarged view, in perspective, of the end structure of FIG. 15;

FIG. 17 is a view, partly in section and partly in elevation taken along the line 17—17 of FIG. 16;

FIG. 18 is a perspective view of the underside of another form of tab of the present invention as illustrated in FIG. 16;

FIG. 19 is a view, partly in section and partly in elevation taken along the line 19—19 of FIG. 18;

FIG. 20 is an isometric view of still another form of the improved end structure of the present invention assembled to a container body shown fragmentarily;

FIG. 21 is an enlarged view, in perspective of the end structure of FIG. 20;

FIG. 22 is a perspective view of the underside of another tab of the present invention as shown in FIG. 21;

FIG. 23 is a view, partly in section and partly in elevation, taken along the line 23—23 of FIG. 22;

FIG. 24 is a view, partly in section and partly in elevation, taken along the line 24—24 of FIG. 22;

FIG. 25 is an enlarged view partly in section and partly in elevation showing the relative relation of the parts prior to the start of an opening sequence;

FIG. 26 is a view similar to FIG. 25 showing the relative relationship of the parts at that point in the opening sequence in which the scoreline is initially popped; and FIG. 27 is a view similar to FIG. 26 illustrating the relative position of the parts as the tab is raised to the full up position in an opening sequence.

DETAILED DESCRIPTION OF THE INVENTION

Figure 9:
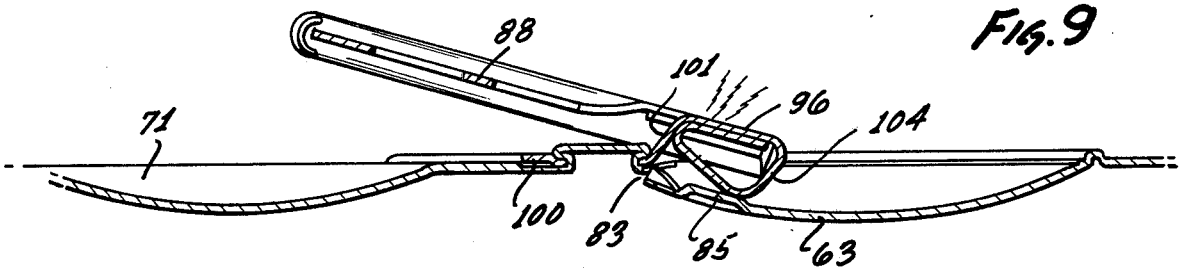
FIG. 9 is a view similar to FIG. 8 showing the relative relationship of the parts at that point in the opening sequence in which the scoreline is initially popped.

Referring to the drawings which illustrate exemplary embodiments of a preferred form of the invention, FIG. 1 shows a container 10 including a side wall 11 having an end closure 12 attached thereto in the usual manner through a peripheral flange 13 on the closure member.

The end structure 12 is formed of sheet material, such as aluminum alloy and the like, and includes a central wall portion 15 having a panel 16 therein, the panel being downwardly dished and at least partially circumscribed by a scoreline 17 which is ruptured to form a pour opening in the end structure. As illustrated, the panel 16 is preferably adjacent to the flange 13 and somewhat offset from the center of the central wall protion, for convenience of pouring. Positioning the panel and the tab off to the side of the center tends to minimize the tendency of the end of the tab to lift up in response to bulging of the end by internal container pressure. It is understood that the panel 16 may be positioned in other locations on the end structure if pressure is not an anticipated problem.

Referring now to FIGS. 1 and 2, the easy-opening end structure 12 includes a tab 25 affixed to the central wall 15, as opposed to the panel 16, by an integral rivet 27 as illustrated. The tab includes a longitudinally rigid body member 28 having a lifting end generally designated 29 and an opening end generally designated 30. In this form, the opening end 30 of the tab includes spaced fingers 32 and 33 extending downwardly from the body member to engage the panel 16. As illustrated, the central wall also includes a finger well 35 positioned therein essentially below the lifting end 29 of the tab 25. In this way, the user may conveniently insert a finger underneath the lifting end of the tab during an opening sequence to be described below.

More specifically, the tab includes two longitudinally extending legs 41 and 42 interconnected, at the rearward end of the tab by a web of material generally designated 43 and at the forward end by a cross-member 44 from which the fingers 32 and 33 depend. Each leg in the region of the cross-member includes a cut-out 45 which overlies the scoreline to permit the tab to be lifted more easily.

To the rear of the opening end of the tab is a flap member 50 extending rearwardly from the cross-member 44 towards the lifting end as shown in FIG. 2. The flap 50 which constitutes an extension of the cross-member 44 forms a separate narrow web of material through which the rivet 27 passes to secure the tab in place on the central wall 15. The side walls of the flap are spaced from the inner surfaces of the legs 42 and 41, and also is spaced from the web 43 and the tab functions as a longitudinally rigid lever.

Located laterally of the center line of the tab is a hinge 55 which retains the panel 16 on the central wall subsequent to rupture of the scoreline 17. The scoreline may be continuous in which event the severed panel falls into the container and remains there.

The scoreline 17, may be of a variety of types, and in the form of the invention described, is of the pinched score variety. The scoreline 17 extends substantially completely around the panel except for the section 55 which is unscored and which forms a hinge. A continuous scoreline may be used in which event, the severed panel 16 falls into the container and remains there. The scoreline in the portion of the central wall 15 adjacent to the rivet is located in a rivet well and underneath the rivet head which overlies the flap 50, as will be described. Thus, the scoreline is close to the vertical wall forming the upstanding rivet.

At the start of an opening sequence, the user inserts a finger between the lifting end 29 of the tab 25 and the finger well 35 to urge the lifting end of the tab upwardly. The initial upward movement of the lifting end results in the fingers of the tab bearing firmly against the panel 16. The fingers on the opening end of the tab are substantially displaced forward of that portion of the scoreline located in the rivet well. Thus, the lifting motion of the end 29 of the tab results in a lifting movement of the rivet through the action of the flap to pull that portion of the central wall surrounding the rivet in a generally upward direction while the fingers hold the panel 16 in place. In this type of opening operation, the tab acts as a class 2 lever in that the fulcrum point is at the finger or opening end of the tab with the scoreline and lifting end being on the same side of the fulcrum.

In the case of beer and beverages containers, an opening operation by which the scoreline is initially ruptured by an upward movement offers the advantage of not having to work against the pressure, if any, which is in the interior of the container.

After the initial pop, the tab then acts as a class 1 lever and the fingers bear against the panel to urge the latter downwardly to effect fracture of the remainder of the scoreline, although it is understood that one may manually rupture the remainder of the scoreline by using a finger. It is preferred, however, that the tab be used which is merely lifted towards the vertical position. After fracture of the scoreline, the tab is pushed back to its original position.

In the form of the present invention illustrated in FIG. 3, the end structure 60 is formed of sheet material, as described, and includes a central wall portion 62 having a panel 63 which is downwardly dished and at least partially circumscribed by a scoreline 17, the panel being located in the end structure as already described.

Attached to the wall 62 rather than the panel is a tab 65, an integral rivet 27 being used. The tab includes a longitudinally rigid body member 68 having a lifting end 69 and a forward opening end 70. The central wall includes a finger well 71 located beneath the lifting end 69 of the tab, as shown.

Cooperating with the scoreline 17 is a bead 72 which surrounds a substantial portion of the scoreline and which includes curved legs 73 and 74 which terminates near but spaced from the finger well as shown in FIG. 4. The bead includes side walls 76 and 77 and a top wall 78 which is essentially flat. The bead operates to absorb tension stresses as pressure tends to expand the end structure. Thus, rather than cracking, the bead absorbs the stresses and protects that portion of the end wall between the arms of the bead from cracking. The portion of the bead adjacent to the scoreline offers some protection to the scoreline from pressure tending to dome the end structure.

Surrounding the rivet, shown in button form 80 is a rivet well 81 in which the metal of the central wall in that portion surrounding the rivet has been coined and reduced in thickness through the application of a compressive force during rivet forming operations, a sequence well known in the art. It will be seen that a portion 83 of the scoreline 17 is closely adjacent to the vertical wall of the rivet and in the rivet well. It is this portion of the scoreline which initially pops during the opening sequence. Forward of the rivet and located in the panel 63 is a button 85 which is raised upwardly and which is located beneath the opening end 70 of the tab 65.

The improved tab of the present invention is preferably formed of sheet material, such as tin plate, and of longitudinally rigid structure so as to function as class 2 and class 1 lever in the opening sequence. Referring to FIGS. 3 and 5 to 7, the tab 65 is made up of a rigid body member including legs 86 and 87 formed of single ply of sheet and curled for strength and for safety. The legs 86 and 87 are interconnected at their one end by a web portion 88 which is depressed downwardly and which forms a bridging web between the upper surface of each leg. The lifting end of the tab includes a notch 89 resulting from severance of a web used to hold the tab during its formation by a progressive set of tools, as is well known. The ends 91 and 92 are curled and radiused to prevent contact with the residual metal in the notch.

At the opening end, a cross-member 92 interconnects legs, the cross-member including a finger 95 which extends downwardly toward the end structure. The opening end of the tab is formed of multiple layers of sheet metal for strength purposes, one layer constituting the face 96 of the cross-member from which the finger 95 is formed, the latter being bent back under to provide a T-layer 97 having spaced ears 98 and 99 received between the curl of the legs 86 and 87.

Extending rearwardly and downwardly is a web 100 apertured to receive the rivet, the web forming an extension of the face 96 and being separated from the flap 88 and the legs 86, 87 adjacent to the web 100. The interconnection between the web 100 and the face 96 is through the connecting web portion 101 while the T-layer 97 is complimentarily curved at 103 so that the connecting portion 101 is not cut as might occur if a free edge of metal from the finger were to bear against the connecting portion 101.

As shown, the finger 95 is centally located at the front end of the tab and includes a rearwardly inclined front wall 104 which tends to prevent the finger 95 from unfolding during an opening sequence. The forward wall includes integral and inclined side members 106, 107 which cover the forward edge of each of the legs 86, 87 so that sharp metal edges are not exposed. In effect the side members 106, 107 function as a barrier and extend downwardly and rearwardly.

Referring now to FIG. 8, the relative position of the parts is illustrated at the start of an opening sequence. The finger 95 initially is spaced a small distance from the button 85 so that some idle lift is provided at the start of an opening sequence. The panel 63 is downwardly dished while the button 85 is raised above the dished portion but still below the level of the remainder of the end wall.

In the relative position of the parts illustrated in FIG. 9, the scoreline has been initially popped, that is, initially fractured in the area of the scoreline in the immediate vicinity designated 83 of the rivet and in the confines of the coined area of the rivet well. The action of the tab is basically that of a class 2 lever since the fulcrum is the opening end and the load and lifting end are on the same side of the fulcrum. It will also be observed that the initial pop is of that portion of the scoreline in the rivet well and forward (to the right as seen in FIG. 9) of the rivet and is operative to release any pressure within the container. Thus the initially fractured segment of the scoreline is beneath the web member 100 and, to some extent, this relative arrangement operates to shield the user from direct exposure to any spray which might emanate from a container under pressure.

It will also be observed that the panel 62 is dished downwardly, as shown in FIGS. 8 and 9, such that any upward force generated by pressure within the container tends to maintain the scoreline 17 in compression. This is desirable from the standpoint of score integrity in the context of minimizing inadvertent rupture of the scoreline due to pressure within the container. Thus, as the pressure within the container increases, as for example by placing a container of beer or soda pop beverage in the sun, the increased pressure tends to increase the compressive forces acting on the scoreline. The opening operation, insofar as the initial rupture of the scoreline is concerned is the result of a tensile type of force applied to the scoreline by an upward pull on the central wall in contrast to a downward push on the panel.

Figure 10:
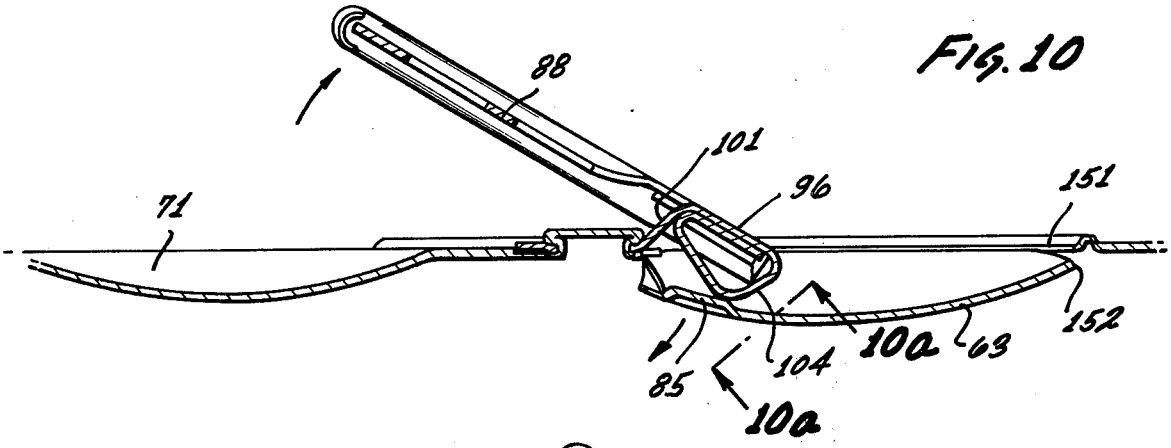
FIG. 10 is a view similar to FIG. 9 showing the relative relationship of the parts after the initial pop and during that portion of the opening sequence in which a substantial portion of the remainder of the scoreline is ruptured.
Figure 10A:
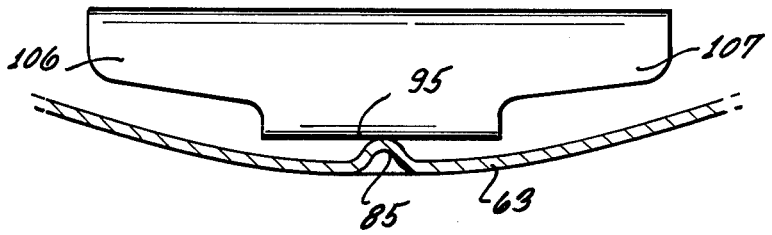
FIG. 10*a* is a view partly in section and partly in elevation taken along the line 10*a*—10*a* of FIG. 10.

Referring now to FIGS. 10 and 10*a*, subsequent to the initial pop of the scoreline as illustrated in FIG. 9, continued lifting movement of the tab in the direction indicated by the arrows in FIGS. 10 and 10*a* results in a class 1 lever type of opening action since the lever is pivoted around the rivet which now acts as a fulcrum causing the forward opening end on which the finger is present to move downwardly in the direction indicated by the arrow. In this type of opening operation, the web 100 and the web portion 101 act as a hinge to permit the opening end of the tab to move downward in response to raising of the lifting end. The next sequence in the opening operation involves continued fracture of the scoreline about a substantial portion of its periphery.

At this point, or after the initial pop, the user has two options available for continued rupture of the scoreline. Either the free end of the tab may be lifted, a preferred mode of operation, or the user may use a finger to push the panel 63 downwardly since a considerable portion of the scoreline has been ruptured. Tests indicated that in the relative position of the lifting end indicated in FIG. 10 very little lifting of the free end of the tab has resulted in the initial pop and a fracture of a substantial portion of the scoreline. Tests of the structure as shown in FIGS. 3–8 indicate that in the relative position shown in FIG. 10, the scoreline is ruptured to about 50 percent of its periphery.

As will be seen from FIGS. 3, 10, and 10*a*, the front of the tab is in chordal relation with the panel 63 which is hinged at 110 on one side of the center line through the rivet 27 and the button 85. The scoreline extends an appreciable distance forward of the button and the latter acts effectively to increase the length of the lever formed by the tab to apply a downward pressure on the panel subsequent to the initial pop to facilitate fracture of the remainder of the scoreline subsequent to the initial pop.

If the user manually depresses the panel 63 by pushing down on it with a finger, the panel hinges about hinge 110 located laterally to the side of center axis of the tab and folds underneath the end wall and out of the way of the opening formed by rupture of the scoreline. The hinge operates to retain the severed panel to the end wall, with the panel being located out of the opening. It will be apparent, therefore, that one may optionally eliminate the hinge so that the panel is free to fall within the container. Because of the geometry, the panel is not capable of coming out of the opening once it has been pushed to the side, in the case of a hinged panel or pushed into the container in the case of a free panel. Thus, the panel remains with the container after the opening. Likewise, the tab remains with the end since the tab is affixed to the central wall portion as opposed to the severed panel. Thus, there is no separate tab and tear strip combination, or a separate free tab, or a separate free panel, potentially capable of causing litter.

Figure 11:
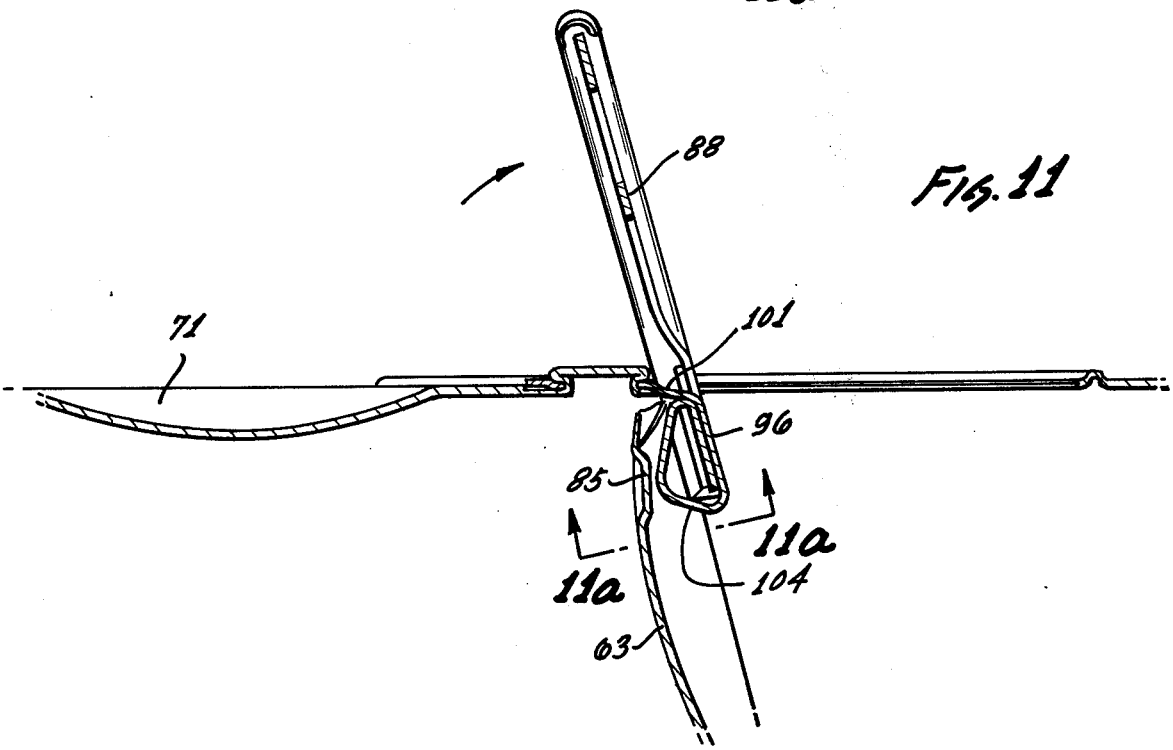
FIG. 11 is a view partly in section and partly in elevation illustrating the relative position of the parts as the tab is raised to the full up position in an opening sequence.
Figure 11A:
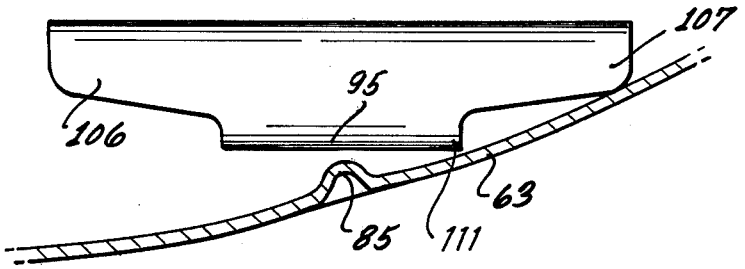
FIG. 11*a* is a view partly in section and partly in elevation taken along the line 11*a*—11*a* of FIG. 11.

At the user's option, the lifting end of the tab may be raised further to the relative position illustrated in FIG. 11. In the transition of tab position from that shown in FIGS. 9 and 10 to that shown in FIG. 11, the finger 95 is operative to bear against the upper surface of the panel to urge the same downwardly and laterally to the side as shown in FIG. 11*a*. Initially, the finger contacts the button for the purpose of rupturing a substantial portion of the scoreline, but as the end of the tab is lifted from the position shown in FIG. 9 to the position shown in FIG. 11, finger 95 is principally operative to urge the panel downwardly and laterally as shown in FIG. 11*a*. As illustrated, the panel has been urged downwardly and laterally about the hinge 110. Since the front of the tab is in a chordal relation, as the panel 63 moves downwardly, the button moves out of contact with the finger, but the edge 111 of the latter and the side member 107 bear directly against the panel 63 to urge the same downwardly about the hinge 110. It is for this reason that the hinge 110, if used, is set to one side or the other of the center line of the tab as illustrated in FIG. 4. With the free end of the tab between 45° and 90°, or at approximately 70° as illustrated in FIG. 11, the panel 63 has been pushed back sufficiently such that it essentially clears the pour opening. Continued upward movement of the lifting end of the tab results in the panel being pushed completely back beyond and out of the way of the opening. The side member 107 is principally operable in the last bit of movement to maintain contact with the panel until it is moved virtually completely out of the opening. Following this operation, the tab may be pushed back against the end wall to approximately the position shown in FIG. 3 where it is out of the user's way.

Figure 12:
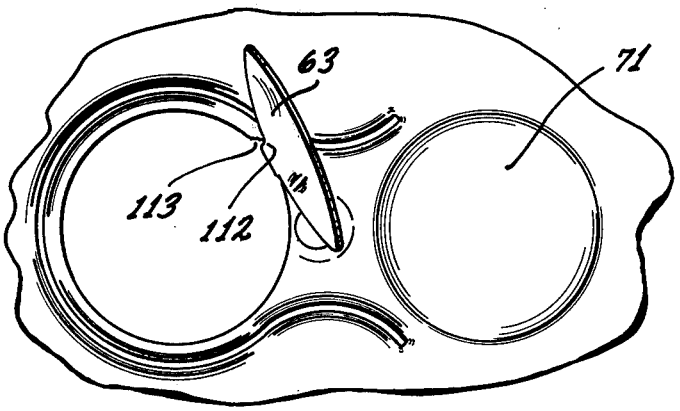
FIG. 12 is a view in perspective of the underside of the end subsequent to an opening sequence.

It is preferred in the practice of the present invention that each of the tab and the panel 63 be retained on the end structure. Accordingly, the web 100 is used to retain the tab while the hinge 110 retains the panel. To prevent the tab from being bent off, it is preferably formed of tin plate. The hinge is so located relative to the panel and tab that as the panel is folded downwardly and to one side as shown in FIG. 12. It should be noted that the hinge tears along its side as illustrated at 112. This tearing action assures that the tab remains retained rather than being sharply folded along the hinge.

For example, if the grain of the metal is at right angles to the hinge line 113, a sharp fold along the grain may be sufficient to weaken the retaining hinge since the fold line is parallel to the grain. By providing a rolling fold and some tearing along the hinge, a sharp fold is eliminated thus assuring retention of the panel even if folded more than once.

In the manufacture of the end structure, five operations are normally used, for example, bubble formation, transformation of the bubble to a button stage, scoreline formation, logo embossing and finally tab staking. In accordance with this invention an improved scoreline is employed of the pinched score variety which offers the advantage that the scoreline may be held in conpression provided the panel is dished downwardly slightly as described.

Figure 13:
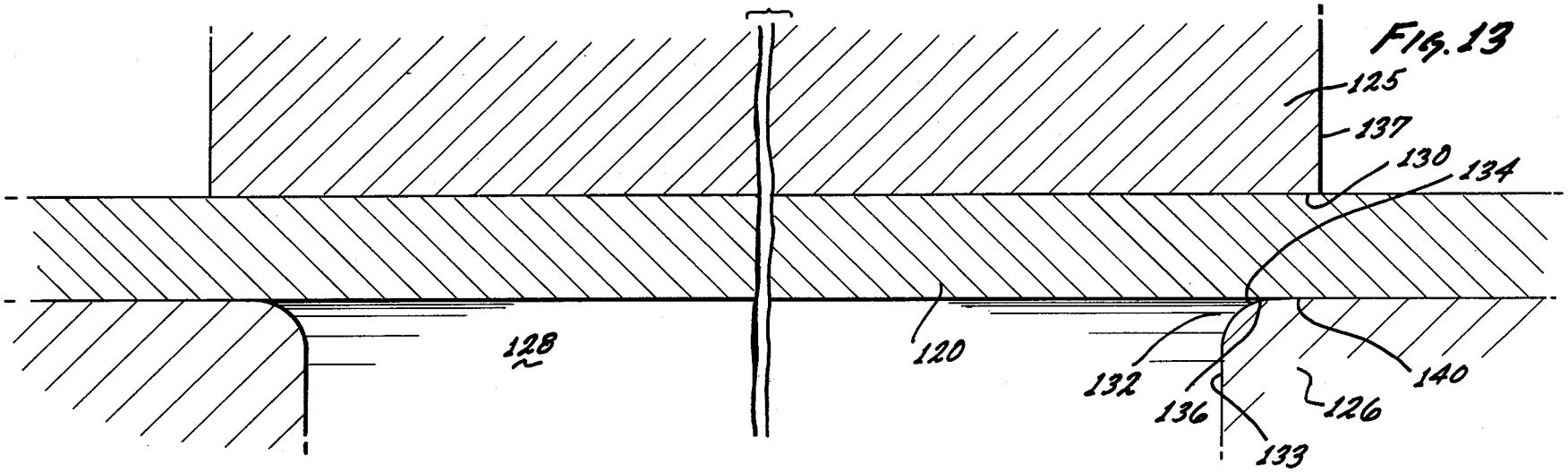
FIG. 13 is a view in section, partly broken away, of the tooling used to form the scoreline of the present invention.
Figure 14:
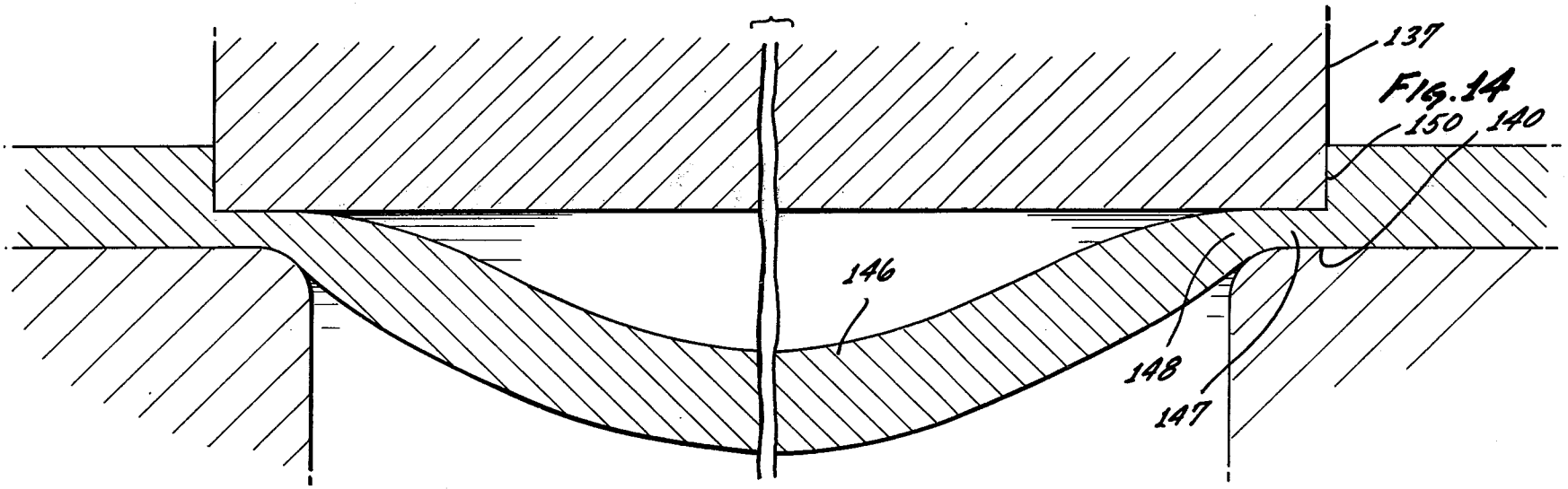
FIG. 14 is a view similar to FIG. 13 showing the simultaneous formation of the scoreline and the dished configuration of the panel forming the opening.

Accordingly, referring to FIGS. 13 and 14, an end blank 120 of approximately 0.0135 inches in section, for example, is positioned between the faces of a punch 125 and cooperating die 126. By way of example, the punch is larger in diameter than the opening 128 in the die such that there is about an 0.009 inch radial overhang 130 all the way around the punch relative to the die. As shown, the die is radiused approximately 0.005 inches at the junction 132 of the vertical wall 133 and the horizontal face 134. Between the end of the radius 136 on the die face and the vertical wall 137 of the punch there is a flat 140 measuring about 0.004 inches, for example, which is circular in plan and which surrounds the opening 128 in the die, but which is spaced radially outwardly thereof.

As the punch comes down to the relative position illustrated in FIG. 14, the cross-section of the blank between the punch and the flat on the die is reduced in cross-section from 0.0135 inches to about 0.0036 inches, for example, in what effectively amounts to pinching of the metal in the area of the flat 140. The excess metal is forced radially inwardly since the metal is not supported in the center section 146 which forms the panel. Thus, there is a gradual transition in the cross-section from the area of minimum cross-section 147 of the scoreline immediately above the flat 140, radially inwardly through a transition zone 148 to the area radially inwadly of the transition zone. As shown, the transition zone gradually increases in cross-section until it approaches the cross-section of the vertical wall 150. Since center section 146 is unsupported and because the die is hollow while the punch is not, simultaneous formation of the scoreline also produces the downward dished portion 146 in one bit of the punch.

The radiused inner wall 136 thus permits the flow of metal radially inwardly while the open die allows movement of the panel downwardly, with the portion of scoreline of thinnest cross-section represented by the narrow band formed between the flat 140 on the die and the opposed face of the punch. Another advantage of the pinched score as described is the fact that in rupturing, the scoreline fractures close to the vertical wall 150 which defines the radial boundary of the scoreline. Thus fracture tends to occur close to the wall 150 resulting in a relatively dull edge along the opening formed in the end as shown at 151 in FIG. 10 while the edge on the panel is somewhat sharper as indicated at 152.

As can be seen from FIG. 14, the principal flow of metal is the band between the punch and die in the zone above the flat 140. The metal above the die does not flow appreciably although the linear dimension of the underside of the end blank increases because of the dished configuration. However, the increase in dimension, or elongation is distributed so that the stretching stress is kept to a minimum.

This type of pinched scoreline also appears to be somewhat resistant to failure as a result of metal corrosion along or in the area of the scoreline. There have been instances in which the generally V-shaped scorelines of the prior art have resulted in a failure mode whose visible sign is corrosion on the non-public or underside of the end structure. More specifically, with certain types of aluminum alloys and/or scorelines, a failure mode exists which appears to be the result of a crack of the laminar grain structure of the metal in a direction across the grain. While the exact cause of the failure mode has not been established, there are indications that some form of fracture occurs from the base or corner of the V-shaped score through the unscored area adjacent to the scoreline. It is also possible that this type of failure mode is in part attributable to the possibility that a particular stock of alloy has a metallurgical composition or grain structure different from what that particular grade of stock should have.

The improved scoreline of the present invention tends to reduce the incidence of this type failure. While the exact reason is not precisely known, it is believed to be the result of the controlled flow of metal during the scoreline formation. Thus, referring to FIG. 13 and 14, as the punch comes down against the die, the portion of the metal between punch and die and immediately above the flat 140 is compressed by essentially a coining type of compressive force. At the same time, there is some flow of metal radially inwardly in a plane parallel to the metal grain structure. In contrast a V-shaped score, results in flow of metal laterally away from the scoring tool in two directions. Thus, if these are defects in the grain or metal, the flow tends to accentuate the defect, alternatively, the action of the scoring tool may create a grain defect. Once created or accentuated, the defect poses a potential problem. Thus the scoring tool and method of this invention reduces creation of defects or accentuating defects because of the controlled compression, and planar flow in one direction.

As will be apparent to those skilled in the art, end structures embodying the principles and advantages of this invention may take other forms. Referring to FIGS. 15 and 16, the end structure 165, again of sheet material such as aluminum or an alloy thereof, is affixed to a container 166 by a flange 168 attached to the container side wall. The end structure includes a central wall portion 170 having a panel 175 therein, the panel being at least partially circumscribed by a scoreline 176 which is ruptured to form a pour opening in the end structure. As illustrated, the panel 175 is adjacent to the flange 168 and somewhat offset from the center of the central wall panel, for the reasons described.

The easy-opening end structure 165 includes a tab 180 affixed to the central wall 170, as opposed to the panel 175, by an integral rivet 182, as illustrated. The tab includes a longitudinally rigid body member 183 having a lifting end 184 and an opening end generally designated 185. In this form, the opening end of the tab includes spaced fingers 186 and 187 which overlie the panel 175. As shown, the central wall 170 includes a finger well 189 positioned essentially below the lifting end 184 of the tab 180. In this way, the user may insert a finger underneath the lifting of the tab during an opening sequence.

The tab 180 is formed preferably from flat sheet stock, and in the preferred practice of this invention, the sheet stock is tin plate. More specifically, the tab 180 includes two longitudinally extending legs 191 and 192 interconnected towards the rear or lifting end of the tab by a web of material 193. The outer peripheral surface of the base along the side edges is curled under at 196 and 197 as shown in FIG. 18, the curl extending towards the rear of the tab at the lifting end as illustrated. In the manufacture of tabs, the tabs are held in the progressive strip at 200 which represents the narrow web which is severed in the formation of the tab to free the finished tab from the strip, in a manner known in the prior art and already described with reference to 89 of FIG. 5. As indicated, strip 200 is recessed inwardly from the curled rear edges 203 of the tab in order to protect the user.

To the rear of the opening end of the tab is a flap member 205 (FIG. 18) of a single thickness of sheet material and extending rearwardly towards the lifting end. The flap forms a separate narrow web of material through which the rivet 182 passes to secure the tab in place on the central wall 170. The side walls of the flap are spaced from the inner surfaces of the legs 191 and 192 and also is spaced from the web 193.

Referring more specifically to FIGS. 18 and 19, the flap 205 formed of a single thickness of sheet material includes a bend portion 206 which forms a continuation of the single thickness of sheet material which defines a cross-arm 207 which interconnects the two legs 191 and 192 at the opening end of the tab. At the forward or opening end of the tab, there is a third finger 210 positioned between legs 191 and 192, the third finger effectively forming a continuation of the flap 205 and including a front curl 211 whose axial dimension in a vertical direction is less than that of the adjacent fingers 186 and 187. The finger 210 includes a planar central portion 212 terminating in a curl 213 which is complimentary to the curled portion 206 of the flap 205. The central curl portion 213 of the third finger effectively forms a T-bar reinforcing member by virtue of extension arms 216 and 217 which are received between curls 197 and 196 at the forward end of the tab. The T-bar connector acts as a reinforcement for the forward end of the tab between the fingers and the portion of the flap 205 through which the rivet is received. As illustrated, fingers 186 and 187 are formed of single sheets of material curled back against the portion of the cooperating curls 196 and 197 which are tucked beneath the fingers. Thus, in the forward portion of the tab, the opening end is formed of a plurality of layers of sheet material illustrated in FIG. 19 as 207 and 212. The curl 213 is provided so that the end of the central panel 212 does not cut through the curled or curved portion 206 of the flap 205 during an opening operation.

The scoreline 176 may be of the pinched score variety already described in connection with the embodiment previously, discussed. Likewise, as previously discussed, the scoreline includes a portion 220 closely adjacent to the rivet 182 and located between the fingers on the forward end of the tab and passing through the rivet well as already described. Located laterally of the rivet and beneath the tab approximately in the area to the rear of finger 186 is a hinge 225. The hinger 225 is generally to the rear of leg 186 such that subsequent to initial pop of the scoreline in the area generally designated 220, the fingers 186 and 187 bear against the panel 175 to effect rupture of the remaining portion of the scoreline 176. As the lifting end of the tab is raised further, substantially the remainder of the scoreline is ruptured, as described, and the panel 175 is urged downwardly and laterally around the hinge 225. In the last increments of movement, finger 186 is operative to urge the panel 175 vertically downwardly and away from the opening formed by the rupture of the scoreline. With the hinge 225 positioned as indicated, movement of the panel 175 subsequent to the initial pop, as a result of a lifting movement of the lifting end of the tab results in a rapid downward and lateral movement of the panel 175 by virture of the fact that the finger 186 contacts the panel.

In the form illustrated, the panel 175 is downwardly dished and generally circular in shape for the reasons already described. Cooperating with the panel is a bead formation 230 which is semi-circular in shape and which extends approximately from the location of leg 192 to a point near the center line of the rivet 182. Referring to FIG. 17, the top 231 of the bead formation is relatively thin in cross-section as compared to the side walls 232 and the end wall 170, the bead being formed by a forming and coining operation. Also, it will be apparent that the bead 230 is provided closely adjacent to the scoreline 176 such that the junction of the inner wall of the bead effectively forms the inner section of the scoreline 176, and the sloping wall 232 adjacent to the panel. The bead 230 operates as a strengthening means to assure proper opening of the end structure in the event that the container is under considerable pressure which tends to dome the center section of the end structure such that the portion of the panel to the left of the rivet center line may be raised somewhat. It has been found that the bead 230 assists in a smooth opening operation In practice, the bead 230 is formed in the end structure prior to formation of the scoreline, for example during the bubble and button formation stage. The bead 72, previously described is of a cross-section as shown in FIG. 17.

As in the forms already described, the end shown in FIGS. 15 and 16 is opened by an initial pop resulting from lifting of the lifting end of the tab which, through the web 205 initiates fracture of the portion of the scoreline 220 to the rear of the opening portion of the tab and in front of the rivet. As noted previously, the initial pop operates as a vent through essentially a class 2 lever type action of the tab during the initial pop phase of the opening operation. Once the initial pop has occurred, further lifting of the tab effectively operates a class 1 type lever to cause the front end of the tab to bear against the panel 175 to effect rupture thereof, and continued lifting to approximately the 60° position from the wall 170 results in substantially complete fracture of the scoreline as well as downward lateral movement of the panel 175. As already described, once a portion of the scoreline has been fractured the user has the option of manually pushing the panel downwardly and out of the way although it is preferred that the tab be used. At approximately 45° to 60° from the horizontal the tab has been effective in rupturing the scoreline about a substantial portion of its periphery, for example 50 percent or more. Following the completion of an opening operation, the tab is pushed back against the end wall essentially to the position illustrated in FIGS. 15 and 16, as already described, and the tab is retained with the end structure while the panel is retained beneath the end structure through the hinge. If a continuous scoreline is used, the panel may freefall into the container where it is likewise retained.

In another form of the present invention, as illustrated in FIG. 20, the end structure 250 is attached to a container through a peripheral flange, as already described. The end structure includes a central wall portion 255, having a panel 256 therein, the panel being dished downwardly and at least partially circumscribed by a scoreline 257 which is ruptured to form a pour opening in the end structure. As already described, the panel 256 is somewhat offset from the center of the central wall portion. Attached to the central wall 255 is a tab structure 260, an integral rivet 265 being used for this purpose. The scoreline 257 is of the pinched score variety as described in connection with FIGS. 13 and 14 and the dished panel is simultaneously formed in one hit of the tooling as described.

Referring to FIGS. 20 and 21, the tab includes longitudinally rigid body member generally designated 261 having a lifting end 262 and an opening end generally designated 264. In the form of tab illustrated in FIG. 21, the opening end of the tab includes a central finger 266 which overlies the panel 256. The finger 266 extends vertically downwardly from the body member towards the downwardly dished panel 256. Cooperating with the tab and provided in the end wall is a finger well 267 whose function has already been described.

Referring now to FIGS. 22–24, the tab 260 is formed from flat sheet stock material, preferably tin plate for strength, and the tab includes the longitudinally extending legs 272 and 274, the legs being interconnected by a web of material 276 at the rearward end thereof as illustrated. Again, the outer peripheral surface of the tab is curled under for strength purposes, as, for example, illustrated at 278 and 279, these curls extending all the way to the forward of opening end of the tab as indicated at 281.

To the rear of the opening end of the tab is a flap 285 of a single thickness of sheet material and extending rearwardly towards the lifting end as shown in FIG. 22. The flap, as described, forms a narrow web of material through which the rivet 265 passes to secure the tab in place on the central wall panel 255 as opposed to the panel 256. The side walls of the flap are spaced from the inner surfaces of legs 272 and 274 of the tab such that the flap may move independently of the remaining tab structure during an opening sequence. To the rear or at the lifting end of the tab there is a strip 287 recessed between the curled ends of the tab, the strip being that portion of the tab which is severed during formation of the tab so as to free the finished tab from the progressive strip, in a manner known in the art.

As illustrated in FIGS. 21 and 22, the finger 266 constitutes an extension of a cross-member 289 which interconnects legs 272 and 274, the cross-member forming one ply of a multi-ply structure at the opening end of the tab. As shown in FIGS. 22 through 24, each of the legs 272 and 274 includes a forward fold flap 291 and 292, respectively which is folded back and underneath the curl. By way of example, fold flap 291, shown in the dotted line position **291*a*, is folded towards the lifting end of the tab prior to formation of the curl, as is the case with fold flap 292. Each of the curled portions 272 and 274 includes a lateral extension 294*a* shown in dotted line which is folded over the associated fold flap to the position 294 shown in FIG. 22. Cooperating with the curl 279 is a second lateral extension shown in folded position 296, this lateral extension being folded over the forward fold flap 292. Subsequent to location of the lateral extensions in the position indicated, the finger is formed over the folded lateral extensions such that the finger includes a center section 297 which contacts the upper surface of the lateral extensions 294 and 296. As indicated in FIG. 22, the portion 298 of the finger contacting the curved portion 299 of flap 285 is curved to form a complimentary curve such that during an opening operation the free end does not cut through the flap 285** or the curved section thereof.

In this way, the cross-member portion at the opening end of the tab includes a multiple ply of sheet material for strength purposes.

Referring to FIGS. 20 and 21, cooperating with the scoreline 257 are a pair of upstanding beads 305 and 306, bead 305 being generally S-shaped and extending from the portion of the central panel 255 adjacent but to the rear of the rivet around a portion of the scoreline which is to the right as viewed in FIG. 21. Bead 306 is somewhat shorter in overall length, but generally a reverse S shape and extends from a point adjacent to the finger well inwardly and around a portion of the outer periphery of the scoreline which is opposite the bead 305. These beads are of a cross-sectional configuration as shown in FIG. 17, and are positioned adjacent to the scoreline such that the inner wall of the bead, that is, the wall of the bead facing the central panel 256, effectively is in the position indicated by sidewall 232 relative to the scoreline as seen in FIG. 17. These bead formations are as previously described with reference to FIG. 17 and operate as reinforcing means to assist in easy opening of the end wall where the container contents are under considerable pressure.

Again referring to FIG. 21, the panel 256 is hinged to the central wall 255 by a hinge member 310 located beneath the cross-member of the tab and to the right of the rivet as seen in FIG. 21. As in the forms already described the portion of the scoreline 315 immediately to the front of the rivet is located in a rivet wall closely adjacent the vertical wall of the rivet, as already described.

Referring to FIGS. 25 through 27, an opening sequence is illustrated as well as the location of the rivet well 316 and the portion 315 of the scoreline which is closely adjacent to the rivet and in the rivet wall. As illustrated in FIG. 25, the finger 266 bears against the downwardly dished panel 256 as the lifting end 212 of the tab is raised, for example to the relative position shown in FIG. 26 and the portion of the scoreline 315 closely adjacent to the rivet is initially popped as indicated at 320. The initial pop phase of an opening operation is accomplished through essentially a class 2 lever action of the tab in that the finger of the tab 260 bears downwardly on the panel 256, but fracture of the scoreline in the initial pop operation is achieved by the tab lifting on the rivet 265 through the flap 285 through which the rivet passes. This upward motion effects the initial pop by raising the portion of the end structure immediately around the rivet in an upward direction resulting in initial fracture of the scoreline in the area 320, as indicated. Subsequently, continued lifting of the lifting end 262 to the relative position indicated in FIG. 27 completes the rupture of the scoreline while the panel 256 is folded downwardly and laterally, while being retained to the central portion of the end structure through the hinge 310. As the end 262 of the tab reaches approximately between 40 and 60 degrees relative to the end, a substantial portion of the periphery of the scoreline is ruptured, approximately 50 percent thereof, and if desired, the user may manually push the panel downwardly into the container although it is preferred that opening be accomplished by raising of the lifting end of the tab to the approximate position shown in FIG. 27. This form of end structure, like those described operates to move the free panel very quickly to the underside of the end structure during an opening operation. With the panel 256 in the downward position and folded laterally underneath the end, the user may now depress the lifting end of the tab 262 back to its original position and each of the tab and the panel are retained with the end structure.

It will be appreciated that in each of the forms shown, the tab is attached other than to the panel which is ruptured, and operation of an opening sequence is through a lifting action of the end of the tab resulting in an upward force to initate rupture of the portion of the scoreline immediately to the front of the rivet, the latter being located other than on the panel being opened. In each form, the opening end of the tab includes at least one downwardly extending finger which performs several functions. Initially the finger member or members bear against the top of the dished panel during the start of an opening sequence and forms the fulcrum of an essentially class 2 lever type tab. While the finger bears against the panel, the front end of the tab does not bear downwardly with sufficient force to fracture the scoreline by a downward pressure. Thus, the finger portion of the tab is spaced a substantial distance from the scoreline as compared to the position of the scoreline relative to the rivet in the region of the scoreline initially popped.

Following the initial pop and the venting action which occurs, continued lifting of the tab results in substantially complete fracture of the scoreline through a class 1 type of lever action. During this phase of the opening sequence, the finger portion of the tab, which is spaced considerably from the region of initial scoreline fracture, operates to bear down on the panel to complete the fracture. Since the opening end of the tab is spaced some distance from the rivet and over the panel, the relatively long arm of the tab from the rivet to the lifting end constitutes a relatively long rigid lever operative in response to small movements of the lifting end to bring substantial force on the panel by the opening end thus fracturing a substantial portion of the scoreline with very little lifting motion.

The opening end of the tab includes a substantially broad face, in a preferred form of tab of this invention, and thus is oriented along a chord on the circular panel. A lifting action results in stressing of the scoreline over a substantial portion of its periphery, again by very little lifting action. Once a substantial portion is ruptured, the finger portion, which projects downwardly, operates to depress the panel downwardly and laterally out of the way of the opening. For this reason the hinge, if used, is laterally disposed relative to the center line of the rivet and tab. As the hinge is located more closely to the rivet, FIG. 1 in comparison to FIGS. 15 and 20, the extent to which the lifting end must be raised to move the panel out of the opening is reduced. Where the hinge is located in the chord to the rear of the opening end of the tab and on one side or the other but forward of the rivet, the geometry is such that the finger portion adjacent to the hinge is operative to move the panel rapidly out of the way of the opening. It is for this reason that with the form of ends shown in FIGS. 15 and 20, there need not be stops on the tab since the geometry of the tab, hinge, etc., favors rapid opening of the panel by a relatively small movement of the lifting end of the tab. Even if the tab is "lifted over", the flap is of sufficient strength to retain the tab to the central panel. Once the opening sequence is completed, the tab is pushed back to its original position, out of the user's way. Unlike some of the ecology ends of the art, there is no exposed retained tear strip which could possibly cause laceration. The tab itself includes no elements capable of causing laceration while the panel is either hinged out of the way or falls into the container. In either case it is caught and not freely disposable.

Thus, from the ecology standpoint the end structure of this invention includes both a retained panel and tab, so there is no separable litter. Where the tab is of tin plate, there is a substantial reduced probability that the tab can be freed from the rivet by bending fracture of the flap.

Each of the forms herein described may be made in five station press, a distinct practical advantage since current equipment may be used after tooling has been changed.

Tests of the ends of this invention, especially those of FIG. 20 under pressure of up to 80 pounds have operated satisfactorily, with little spraying during the initial pop phase of the opening operation. Consumer testing also reveals little difficulty in the manipulations needed to open the container. The lifting action is similar to the full panel pull out containers now in wide use, although the mode of operation is considerably different.

It will be apparent to those skilled in the art that various modifications and changes may be made without departing from the spirit and scope of this invention as defined in the appended claims.

I claim:

1. An easy-opening end structure for use with a container wherein the contents of the container are normally under pressure comprising:

an end wall of sheet material;

means cooperating with the end wall for attachment to a container;

means in said end wall defining a panel at least partially circumscribed by a scoreline to form an opening in said end wall;

tab means including a lifting end and an opening end;

said opening end of said tab including depending finger means operative to bear against said panel in an opening sequence, means to affix said tab means to said end wall such that the opening end thereof overlies said panel whereby the tab remains affixed to said end wall after formation of said opening;

means integral with the end wall to secure said panel to said end wall subsequent to rupture of said scoreline;

said means to secure said panel being located laterally of said affixing means;

said scoreline including a portion located between the opening end of the tab and said affixing means;

said tab being a longitudinally rigid lever operative in response to raising the lifting end thereof to cause the opening end of the tab to bear against said panel and to initiate rupture of the portion of the scoreline located between the opening end of the tab and the affixing means by a class 2 lever action; and said tab being operative as a class 1 lever subsequent to the initial rupture of said portion of said scoreline to effect rupture of the remainder of said scoreline progressively from said portion of the scoreline towards said means to secure said panel and to urge said panel downwardly and laterally during the progressive rupture of said scoreline.

2. An easy-opening end structure as set forth in claim 1 wherein said portion of said scoreline which is initially ruptured is closer to said affixing means than to the opening end of said tab.

3. An easy-opening end structure as set forth in claim 1 wherein said tab is of sheet material and includes an opening end portion having a plurality of layers of sheet material.

4. An easy opening end structure as set forth in claim 1 wherein said tab includes spaced side arm and a cross-member joining said side arms.

flap means extending from said cross-member toward the lifting end of said tab and cooperating with said attaching means to retain said tab to said end wall, and said flap means being operative during the class 2 lever action of said tab to lift attaching means and the portion of the end wall surrounding said attaching means.

5. An easy-opening end structure as set forth in claim 4 wherein said finger means extends downwardly from said cross member.

6. An easy-opening end structure as set forth in claim 1 wherein said scoreline is discontinuous , and said means integral with the end wall being an integral hinge formed in the discontinuous portion of said scoreline.

7. An easy-opening end structure as set forth in claim 6 wherein said finger means extends downwardly and bears against the panel during an opening sequence, and said finger means being positioned in alignment with said affixing means and operative in response to lifting of the lifting end of said tab to urge said panel downwardly subsequent to initial rupture of the scoreline.

8. An easy-opening end structure for use with a container comprising:

an end wall and means to attach the end wall to a container;

means in said end wall forming a line of weakness defining a panel at least partially removable to form a pour opening;

tab means including a lifting end and an opening end ;

said tab including flap means located between the lifting and opening end thereof;

the opening end of said tab including finger means in alignment with said flap and extending downwardly for contact with said panel, rivet means affixed to said flap to secure said tab to said end wall such that the opening end thereof overlies the panel whereby the tab remains affixed to said end wall after formation of said pour opening, said line of weakness including a portion located between the opening end of said tab and said rivet, and said tab being a longitudinally rigid lever operative as a class two lever to initiate rupture of said portion of the line of weakness in response to lifting the lifting end thereof by said means on the opening end of said tab bearing downwardly against said panel while said flap lifts said rivet and the portion of the end wall surrounding said rivet upwardly and operative as a class 1 lever to fracture the remainder of said line of weakness.

9. An easy-opening end structure as set forth in claim 8 wherein the opening end of said tab is formed of at least a plurality of layers of sheet material and wherein said finger means is formed in the lower-most layer of said plurality of layers.

10. An easy-opening end structure as set forth in claim 9 wherein said finger means includes at least one downwardly extending finger member.

11. An easy-opening end structure as set forth in claim 9 wherein said tab includes a cross-member at said lifting end, said finger means being arranged to extend downwardly from the cross-member, and said cross-member defining a relatively broad face of said tab.

12. An easy-opening end as set forth in claim 11 wherein said line of weakness includes a portion generally circular in shape, and said tab being affixed to said end wall such that the relatively broad face thereof is in a chordal orientation relative to said line of weakness.

13. an easy-opening end structure as set forth in claim 8 including hinge means for retaining said panel on end structure subsequent to rupture of said line of weakness.

14. An easy-opening end structure for use with a container comprising:

an end wall of sheet material;

means cooperating with the end wall for attachment to a container;

means in said end wall defining a panel at least partially circumscribed by a scoreline to form an opening in said end wall;

tab means including a lifting end and an opening end and finger means on said opening end;

rivet means to affix said tab means to said end wall such that the opening end thereof overlies and said finger means bear against said panel whereby the tab remains affixed to said end wall after formation of said opening;

said scoreline including a portion located between the opening end of the tab and said rivet means;

said tab being a longitudinally rigid lever and including spaced side legs, and being operative in response to raising the lifting end thereof to cause the finger means on the opening end of the tab to bear against said panel and to initiate rupture of the portion of the scoreline located between the opening end of the tab and the affixing means by essentially a class two lever action; and said tab being operative as a class one lever in response to raising the lifting end thereof to urge said panel downwardly to effect rupture of the remainder of the scoreline.

15. An easy-opening end structure as set forth in claim 14 wherein said tab includes cross-member means at the opening end thereof interconnecting said side legs, said tab being formed of sheet material, and said cross-member means being formed of at least two plys of sheet material.

16. An easy-opening end structure as set forth in claim 14 wherein said panel includes hinge means laterally positioned with respect to said rivet.

17. An easy-opening end structure as set forth in claim 14 wherein said hinge means is located beneath the opening end of said tab and forward of said rivet.

18. An easy-opening end structure as set forth in claim 17 wherein said finger means includes a single finger spaced inwardly of each of said side legs.

19. An easy-opening end structure as set forth in claim 14 wherein said rivet is surrounded by a rivet well of sheet material of reduced cross-section; and said portion of said scoreline being located in said rivet well forward of said rivet.

20. An easy-opening end structure as set forth in claim 14 wherein said opening end of said tab includes a broad face disposed in chordal relation with said scoreline.

21. An easy-opening end structure for use with a container wherein the contents of the container are normally under pressure comprising:

an end wall of sheet material;

means cooperating with the end wall for attachment to a container;

means in said end wall defining a panel partially circumscribed by a scoreline to form an opening in said end wall;

tab means including a lifting end and an opening end;

said tab being formed of multiple folds of sheet material and the opening end thereof including depending finger means overlying and bearing against said panel, rivet means to affix said tab means to said end wall such that the opening end thereof overlies said panel whereby the tab remains affixed to said end wall after formation of said opening;

said scoreline including a portion located between the opening end of the tab and said rivet means;

said panel including hinge means retaining said panel to said end wall upon rupture of said scoreline;

bead means adjacent at least a portion of said scoreline;

said tab being a longitudinally rigid lever operative by virture of the internal pressure within the container and said finger means on the opening end of said tab to function as a class 2 lever in response to raising the lifting end thereof to cause the opening end of the tab to bear against said panel and to initiate rupture of the portion of the scoreline located between the opening end of the tab and the rivet means; and said tab being operative as a class 1 lever in response to raising the lifting end thereof to urge said panel downwardly to effect rupture of the ramainder of the scoreline and to urge said hinge panel through the formed opening.

22. An easy-opening end structure as set forth in claim 21 wherein said tab includes spaced side legs and a cross-member therebetween at the opening end, flap means extending from said cross-member towards said lifting end for receiving said rivet means, and said opening end of said tab including a centrally disposed finger bearing against said panel in chordal relation to said scoreline.

23. An improved tab of sheet material for use with an easy-opening end structure comprising:

a relatively rigid body member having a lifting end and an opening end spaced from the lifting end;

said body member including spaced leg means; said leg means being curled under to provide for reinforcement of said legs;

means between said legs and between said lifting and opening end for receiving affixing means to attach said tab to an end structure;

cross-member means interconnecting said spaced legs at the opening end; and finger means projecting downwardly from said cross-member and below said legs at said opening end for contacting the panel in the end to be ruptured and operative as a class two lever to initiate rupture of a scoreline and operative as a class one lever to complete rupture thereof.

24. An improved tab as set forth in claim 23 wherein said cross-member is formed of at least two plys of sheet material.

25. An improved tab as set forth in claim 23 wherein said finger means includes a finger spaced inwardly of said legs.

26. An improved tab as set forth in claim 23 wherein said means to attach said tab to an end structure includes flap means extending from said cross-member towards the opening end of said tab, said flap means being spaced inwardly of said legs, and said flap forming a continuation of the upper portion of said cross-member.

* * * * *